US007235004B2

(12) United States Patent
Friel, Sr. et al.

(10) Patent No.: US 7,235,004 B2
(45) Date of Patent: Jun. 26, 2007

(54) PRECISION MEANS FOR SHARPENING AND CREATION OF MICROBLADES ALONG CUTTING EDGES

(75) Inventors: Daniel D. Friel, Sr., Greenville, DE (US); Robert P. Bigliano, Wilmington, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 10/803,419

(22) Filed: Mar. 18, 2004

(65) Prior Publication Data

US 2004/0198198 A1 Oct. 7, 2004

Related U.S. Application Data

(60) Provisional application No. 60/457,993, filed on Mar. 27, 2003.

(51) Int. Cl.
*B24B 1/00* (2006.01)
*B24B 3/00* (2006.01)

(52) U.S. Cl. ..... 451/198; 451/65; 451/349; 451/555

(58) Field of Classification Search ..... 451/349, 451/344, 45, 540, 555–558, 65, 198
See application file for complete search history.

(56) References Cited

U.S. PATENT DOCUMENTS 1,075,690 A 10/1913 Buck
1,181,161 A 5/1916 Perry
1,681,763 A 8/1928 Eaton
2,098,530 A 11/1937 Battocchi
2,249,218 A 7/1941 Meade
2,559,273 A * 7/1951 Brinkley ..... 76/88
2,645,066 A * 7/1953 Andrews ..... 451/555
2,652,667 A 9/1953 Claude
2,896,482 A 7/1959 Thomas
3,332,173 A 7/1967 McMaster
3,619,955 A 11/1971 Fischback
3,819,170 A 6/1974 Longbrake
4,170,343 A 10/1979 Longbrake
4,441,279 A 4/1984 Storm et al.
4,486,982 A 12/1984 Longbrake
4,512,112 A 4/1985 LeVine
4,538,382 A 9/1985 Johannsen
4,602,531 A 7/1986 Korhonen
4,611,437 A * 9/1986 Cohen ..... 451/461
4,627,194 A 12/1986 Friel
4,714,239 A 12/1987 LeVine
4,716,689 A 1/1988 Friel
4,777,770 A 10/1988 LeVine
4,799,335 A * 1/1989 Battocchi ..... 451/241
4,807,399 A 2/1989 Friel (Continued)

*Primary Examiner*—Hadi Shakeri
(74) *Attorney, Agent, or Firm*—Connolly Bove

(57) ABSTRACT

A knife-edge conditioning apparatus comprises at least one precision angled knife guide with one face of the knife blade maintained in sustained sliding or rolling contact and which guides the elongated edge of the blade into sustained contact with the hardened surface of an object and positions the plane of the adjacent edge facet at a precise predetermined angle relative to the contact plane of the hardened surface made of a material of equal or greater hardness than the metal of the knife blade without any tendency to abrade as the blade face is moved along the guide with its elongated edge in sustained contact with the hardened surface.

20 Claims, 9 Drawing Sheets

U.S. PATENT DOCUMENTS

D303,209 S 9/1989 Friel
4,897,965 A 2/1990 Friel
4,912,881 A 4/1990 McDougall
D310,620 S 9/1990 Friel
5,005,319 A 4/1991 Friel
D328,410 S 8/1992 Friel
5,148,634 A 9/1992 Bigliano et al.
5,185,958 A 2/1993 Dale
5,199,225 A 4/1993 Esposito
5,245,791 A 9/1993 Bigliano et al.
D342,003 S 12/1993 Friel et al.
D348,598 S 7/1994 Friel et al.
5,357,717 A 10/1994 Friel et al.
5,390,431 A 2/1995 Friel
D357,395 S 4/1995 Friel
5,404,679 A 4/1995 Friel et al.
5,440,953 A * 8/1995 Gangelhoff et al. ..... 76/86
5,449,315 A 9/1995 Friel et al.
5,458,534 A * 10/1995 Campione et al. ..... 451/555
D368,217 S 3/1996 Friel
5,582,535 A * 12/1996 Friel ..... 451/45
5,582,542 A 12/1996 Stein
5,611,726 A 3/1997 Friel et al.
5,636,556 A 6/1997 Friedlander
5,667,427 A 9/1997 Airhart
D388,304 S 12/1997 Friel
5,868,611 A 2/1999 Friel
D408,254 S 4/1999 Friel et al.
D409,891 S 5/1999 Friel et al.
6,012,971 A 1/2000 Friel et al.
6,113,476 A 9/2000 Friel et al.
6,267,652 B1 7/2001 Friel et al.
6,371,841 B1 4/2002 Ray
6,726,551 B2 4/2004 Friel
6,863,600 B2 3/2005 Friel
6,875,093 B2 4/2005 Friel et al.
7,052,385 B1 5/2006 Swartz

* cited by examiner

PRECISION MEANS FOR SHARPENING AND CREATION OF MICROBLADES ALONG CUTTING EDGES

CROSS REFERENCE TO RELATED APPLICATION

This application is based on provisional application Ser. No. 60/457,993, filed Mar. 27, 2003.

BACKGROUND OF INVENTION

This application relates to a precision means for creation of microblades along the edge of a cutting blade. A number of abrasive based sharpening devices have been described in patents by these inventors and others for the purpose of creating ultrasharp knife edges. Such edges are ideal for the wide range of applications where the sharpest edges are important. Examples of such applications include razor blades, scalpels, and microtome blades for optimal cutting of ultrathin slices of harder non-fibrous materials. The cross section of edges suitable for such applications show that the edge facets meet at a very precise point or terminus which is less than a few microns in width and for use in ultramicrotomes the edge width is commonly as small as 50 angstroms. Generally for such precision slicing the edge as seen in linear profile is commonly very straight and free of imperfections greater in size than the edge thickness.

There are however a range of applications involving relatively softer fibrous material such as meats, fibrous muscle, and fibrous vegetables where small imperfections along the edge profile and across the terminous of the edge facets can facilitate the cutting of such materials.

SUMMARY OF INVENTION

This application discloses precision means of creating micro imperfections of controlled size and frequency along the edge of blades to be used for cutting of such softer fibrous materials. A wide range of serrated blades are sold with deliberate and large mechanical serrations machined along the edge of the blade for cutting of similar materials and especially those with a hard crusty nature where the cutting is improved by the saw-like action of such blades. Such serrations if large, result in substantial visual tearing and fragmenting of the substance being cut.

This application describes highly precise mechanisms and devices that for the first time offer controlled means for preparing reproducibly edges of high geometric precision with microblades at the terminus of the edge facets and along the edge profile. Such imperfections can range in size from a fraction of a micron up to more than 100 microns. Imperfections of this size can function as microblades especially if the microblades are confined largely within the geometric confines of the facets and within the geometric extensions of the original facets to the point where they would otherwise meet to form an edge of thickness generally less than 20 microns.

Knife manufacturers have for generations offered a variety of elongated steel rods (often referred to as "steels") to align the blade edge. For the vast public these have proven extremely difficult or impossible to use because of the inability of the user to manually control either the angle of contact with the edge facet, the directionality of the blade, or the pressure applied by the steel to the blade edge. Because few, if any individuals have the skill needed to move the knife blade reproducibly at a consistent angle and pressure against the rod stroke-after-stroke, the use of these tools for improving the cutting ability of an edge has been very limited. From a practical viewpoint most individuals are alarmed by the potential danger of seriously cutting themselves while manually swinging a sharp blade against the rod. Consequently the advantages sought by this means have not in reality become achievable by the average cook or general public.

Use of the manual steel rod has been more of a mystique than a science, lacking any scientific base or understanding. It has been said for example that the manual rods "smooth out microscopic nicks in the blades surface and realigns the molecules in the cutting edge". Also one reads that "the best steels are magnetized to help draw the molecules into realignment," or "the alignment of molecules in a knife blade are reinforced whenever it is sharpened, . . . and the process removes very little actual metal from the blade." Others repeat that the use of a steel "realigns and smoothes the knife's edge".

It is clear to anyone founded in science and physics that the force of magnetism incorporated in commercial sharpening rods is far too feeble to have any effect at the atomic level in steel and even too feeble to alter the physical structure of any burr attached to the edge.

A number of manual rod-type sharpening devices have been described in issued U.S. patents including:

U.S. Pat. No. 5,046,385 to Ivo Cozzini; U.S Pat. No. 2,461,690 to K. K. Leong; U.S. Pat. No. 4,799,335 to Silvio R. Battachi; U.S. Pat. No. 4,197,677 to Louis N. Graves; U.S. Pat. No. 4,094,106 to Thomas D. Harris; U.S. Pat. No. 4,090,418 to Shigyoshi Ishida; U.S. Pat. No. 5,163,251 to David Lee. For a variety of individualized reasons none of the prior art devices have proven to be a practical means of reproducibly modifying the physical structure along a cutting edge. None of these cited patents include means to orient with sufficient precision or consistency the angle of the edge facet relative to the hardened surface of a steel rod or other material needed to achieve the results reported in this application. Where there is an effort in the prior art to provide a guide for the knife the means used is angularly inconsistent or inaccurate because of variations in blade geometry, blade height, thickness of blade, etc. or because the accuracy of the means is inherently very poor and variable stroke to stroke.

Commonly in the prior art the angle of the facet as presented to a hardened surface is totally dependent on operator skill. Consequently these designs lack the precision and reproducibility discovered by these inventors to be necessary for creating an optimum and consistent structure of microblades along the cutting edge of blades irrespective of the geometry and size of the blade geometry or the skill of the user of such devices.

The edge conditioning mechanism disclosed here depends among other things upon highly accurate angular referencing of a blade's edge based on the most reproducible feature of a blade, namely the planes defined by the large faces of the blade that can be held in precise alignment on a flat physical plane to insure the required angular accuracy, independent of variations in other physical features of the blade.

The invention is based on the discovery that when the linear edge of a sharpened knife blade is pressed against or dragged along a hardened surface (hardness preferably above Rockwell C-60 but in any event preferably harder than the blade edge) in the general direction of the edge linear axis in a carefully controlled manner so that the plane of the edge facet adjacent to the hardened surface is positioned consistently at an angle, optimally only a few degrees from the plane of the hardened surface with an appropriate force against that surface a surprising sequence of events takes place along that edge. Contrary to popular belief, the burr created during the preceding sharpening step is not straightened but first is deformed, removed, cracked, or pressed against one side of the edge and ultimately fragmented as micro sections along the edge are broken off leaving a microserrated edge. The burr may be removed, pressed against the first facet or it can be moved to the opposite side of the edge and pressed against that facet. This physical action of moving the burr fragments from one side of the edge to the other or pressing them against the edge causes serious breaks and irregularities along the edge structure of a size ranging from a few thousandths of an inch to as little as 1 micron. As one then continues to stroke the blade edge facets repeatedly across an appropriate hardened surface at the same consistent small relative angle, micro facets are established at the terminus of the larger facets and a small microserrated structure is created. Study of this process has shown that if the angular relationship between the hardened surface and the contacting edge facet is closely and consistently controlled and the applied pressure is regulated the average size and frequency of the microstructure along the edge of a given knife surprisingly is quite reproducible each time the process is repeated. Because dimensions of the microstructure is extremely small, the resulting edge—so created—is razor sharp yet an edge that cuts fibrous materials exceedingly well. As described later, the nature of the edge structure can be modified by altering the angular relationships but a consistent and predictable result depends critically on precise control of the angle on each stroke along the knife edge.

As described earlier both the precision of the physical geometry along the cutting edge of a blade and the existence of microstructure along the edge can play significant roles in the cutting ability of blade depending on the nature of the material being cut. Near perfect geometry of the edge formed by the facets that support that edge is important if one wishes to cut thin slices or to control more precisely the course or path of an edge as it penetrates the material being cut. Even greater geometric edge perfection is necessary for cutting ultra thin slices of stiffer and harder materials. Likewise for cutting of softer fibrous materials geometric perfection is important if one wishes to cut extremely thin slices, however, the existence of a series of microblades or microimperfections along an edge can be an added advantage to cut softer fibrous materials that can otherwise deform slightly under the pressure of cutting and thus offer resistance to being severed by a smoother more perfect geometric edge. For these reasons the most versatile cutting edge for the softer materials is one with controlled imperfections or microblades along an edge that otherwise has a high degree of geometric perfection. Without the geometric perfection it becomes more difficult to cut thin sections. Without edge imperfections, cutting of fibrous materials is more difficult. For these reasons close control of all factors affecting this edge conditioning step are important in order to optimize the profile of the final edge and any imperfections or microblades created along that edge.

THE DRAWINGS

DETAILED DESCRIPTION

Figure 1:
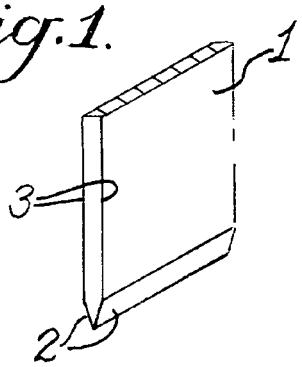
FIGS. 1-9 illustrate various knife edges.
Figure 2:
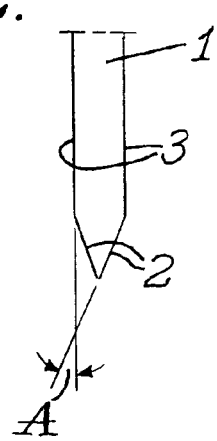
Figure 3:
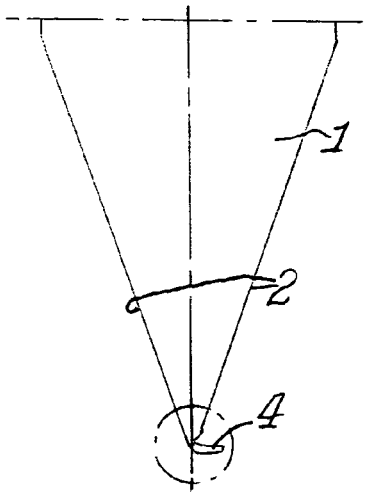
Figure 4:
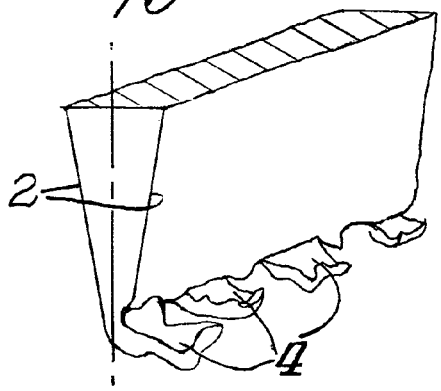
Figure 5:
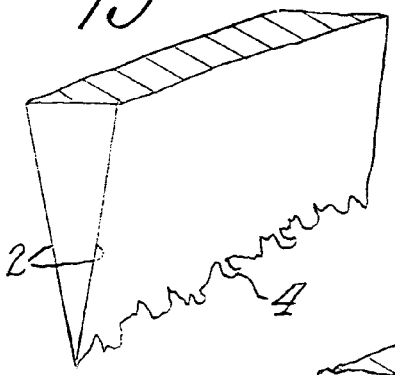
Figure 6:
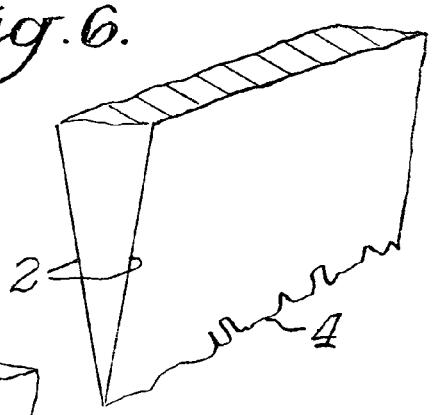

FIG. 1 shows a conventional double faceted knife blade 1 with two faces 3 that terminate at facets 2, each of which is formed at an angle A, FIG. 2 relative to the blade faces 3. Generally each of the facets is sharpened at angle A and meet at the edge. The character of the edge itself depends on the means used to sharpen the facets; however, if the facets are ground by conventional means a burr 4 will be created along the edge as seen in FIGS. 3 and 4, the latter being a very large enlargement of the circled area, FIG. 3, of the edge itself. FIG. 4 is the view of a freshly sharpened edge, showing a series of individual burr structures bent almost perpendicular to the center line of the two facets. FIG. 5 shows the facets 2 and burr remnants 4 along the same knife edge of FIG. 4 as they might appear after the facets have been in forced rubbing contact several times at a consistent and precisely controlled angle with reference to the plane of a hardened surface, moving in a direction nominally aligned with the linear edge of the blade. FIG. 6 shows the edge structure after; (a) its back facet has been pressed repeated at the same controlled angle against the hardened surface; and (b) the front facet has been pressed similarly against the hardened surface. The exact nature of these edge transformations depends of course on the pressure applied to the edge against the hardened surface, the relative angle between the plane of the facet and that of the hardened surfaces and the number of strokes against the hardened surface. Most of the original burr structure will have been removed at this point and the desired microstructure begins to develop along the edge.

Figure 7:
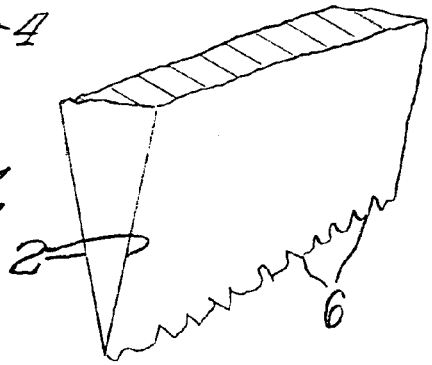

By repeating the step of pressing alternately one side and then the other side of the edge against a hardened surface on the order of 10-20 times, at a precisely controlled angle, the attachment of the burrs to the terminus of the facets is broken and remaining pieces of the burr are broken off leaving an edge structure similar to that shown in FIG. 7. The additional pressing of the resulting edge structure against a hardened surface at a precisely controlled angle leaves a surprisingly regular fine microtooth structure along the edge as shown. As explained later success with this technique is possible only if the angle of the plane of the contacting facet is held consistently stroke after stroke at the same precise angle relative to the surface of the hardened surface at the point of contact.

The microteeth thus created along the knife edge can improve the effectiveness of cutting a range of materials including fibrous foods.

The process of pressing slidingly the edge against the surface of a hardened material as it is moved in a direction approximately in line with the axis of the edge and with a consistent precisely controlled angle stroke after stroke between the plane of that surface and the plane of the facet can be repeated hundreds or thousands of times before the knife edge facets need to be resharpened (reangled). This is particularly so if the angle between the facet and the hardened surface is small—for example in the range of 3-10 degrees. The repetitive contacting causes the remaining edge structure to work harden and as a consequence repeatedly fracture leaving ultrafine microteeth along the edge. It is important to understand that the mechanism and accuracy of alignment must be sufficiently precise that the area of contact along the edge's facet is rigorously confined to the lower portion of the facet very close to the edge. However, as this rubbing process is repeated hundreds or thousands of times, the repeated fracturing along the edge removes an initial row of microteeth along the edge and another new replacement row of microteeth are formed along the remaining edge structure. This process must be precisely controlled by the use of angle guides and preferably with the assistance of means to hold the blade face securely against the guides—otherwise one poorly aligned contact stroke along the edge can wipe out much of the microstructure and render less effective the cutting ability of the edge. As this process is repeated, microamounts of metal are removed along the edge by repeated fracturing along the edge and by microshearing along the lower portion of the facet surface. As the edge itself is repeatedly stress hardened, fractured, and broken off the width of the blade facet (as measured perpendicular to the edge) is shortened but at the same time the line or area of actual contact between, for example a cylindrically shaped hardened surface and the facet surface slowly lengthens requiring that a slightly greater pressure be applied between the facet and the hardened surface in order to remove microamounts of metal from the facet and to maintain sustained and adequate contact with the edge and its fracturing microstructure. At that point it may become more economical of time and effort for the user to conclude that the edge needs to be resharpened in order to provide a more favorable relative angle between the lower portion of the facet and the surface of the hardened material. This mechanism is described in greater detail in subsequent sections.

The micro nature and precision of this edge conditioning process becomes evident by recognizing that initially this operation is confined entirely to the lower 1%-10% of the facet adjacent to the edge. The facet on a relatively new knife is commonly only about 0.025" (0.6 mm) wide. This means that the initial area of contact with the hardened surface is confined to that area of the facet within about 0.002" (0.05 mm) of the edge itself. As the facet is pressed repeatedly hundreds of times across a corresponding area on the hardened surface the area of the facet in contact does slightly increase because of a wearing action close to the edge and that area in contact will ultimately extend upward on the facet toward the shoulder where the facet meets the face of the blade. As that process continues the force applied to the blade is distributed over a larger area of the facet and the stress level applied at the point closest to the edge is reduced. However, whenever the blade is used for cutting, lateral distortions of the microteeth do occur which increases the lateral stress on these teeth during subsequent reconditioning and thereby contributes to the continuing removal and reestablishment of microteeth along the stressed and stress hardened edge.

The microprecision nature of this novel conditioning process is emphasized by realizing that the amount of metal removed along the edge of a 10 inch blade as a result of a thousand controlled strokes along that edge is miniscule and only about 5-10 milligrams of steel.

It is important to recognize that this controlled repetitive action described here to develop microstructure along the edge is radically different from conventional sharpeners that use skiving actions to remove an entire facet, quickly in just one or a few strokes, and to thereby establish new facets and a new knife edge. The conventional skiving devices are analogous to conventional sharpening devices that are designed to form a new edge by removing in entirety the old facets and replacing them with new facets commonly created at a poorly defined angle. The variety of available skiving sharpeners includes those that utilize a very sharp edge of a hardened material such as silicon or tungsten carbide to remove at uncontrolled angles substantial amounts of metal in a single stroke and to completely replace the entire facet in a very few strokes. These skiving devices also are available with interdigitating sharply edged wheels or corners of hardened metal or ceramics. They do not include means of precise angle control and hence are not suitable and unsatisfactory for precise edge conditioning of the type described herein.

The inventors have discovered that this new micro manipulative means of creating microteeth along a cutting edge must be precisely controlled if results are to be optimized. For best results the angle of contact B, FIG. 9 between the surface 2 of the edge facet and the surface 5 of the hardened surface at the point or line of contact must be reproducible and held constant with great accuracy in order that the rate of conversion of the burred edge into a microtooth edge, 6 of FIG. 7, is controlled. The best cutting edge will usually be obtained when all of the initial burr is removed and the microtooth structure is created.

The edge of FIGS. 3 and 4 as shown with a dominant burr will not cut well. An edge cuts significantly better as the burr structure is removed and the microteeth are created. The edge as shown in FIG. 6 will cut reasonably well but it cuts much better when modified further to the edge structure of FIG. 7. Clearly if the thickness W of the edge terminus becomes too large, FIG. 8, the advantage of having the microteeth would be somewhat diminished. Consequently there is a distinct advantage to creating an edge with microteeth and it is even better to do that in a manner that minimizes the effective thickness of the edge at its terminus.

Figure 9:
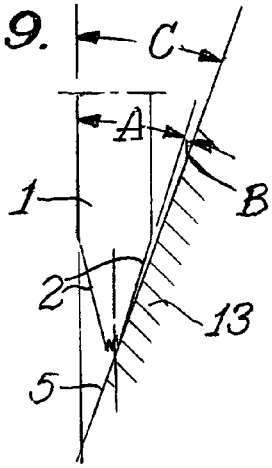

The inventors have been able to demonstrate that if the angle B, FIG. 9, between the plane of the facet 2 and the plane of the hardened surface 5 of hardened material at the point of contact is held to less than 5°, relative to the facets as the edge facets are moved repeatedly on alternate facets along the hardened surface 5 the burr will be worn off relatively fast and the microteeth will be created with a little to no increase in the effective edge thickness. An edge thickness of 5 microns is easily obtainable. However, if the angle B is much greater than 5 degrees there is greater bending of the frail edge on each stroke which breaks off microteeth prematurely and detrimentally enlarges the effective thickness of the edge as it fractures. At still larger angles the hardened surface rubs to a greater extent under the edge tending to broaden and smooth the microstructure thereby reducing that structure and reducing its cutting effectiveness.

Attempts to condition a freshly sharpened faceted edge by moving the knife manually and striking its edge against a hardened surface without precise control of the angle of contact between the surface of the facet and the hardened surface quickly compromises or destroys the quality of the microstructure created along the edge and results in edges with far less than optimum cutting ability. Further, the repeated contact at differing angles and from differing directions on successive strokes interferes with the orderly formation of the microstructure and an optimum edge is never obtained. The edge must consequently be resharpened more frequently and the life of the blade is shortened. Consistent use of a precise angle guide for the blade stroke-after-stroke is necessary in order to avoid; (a) striking the blade at an angle less than angle A, FIG. 9, of the facet so that the edge itself does not contact the hardened surface; or (b) pressing the edge at an exceedingly large angle or with excessive force that will widen the edge and interfere with the efficient removal of the burr and development of the optimum microstructure along the edge. The fact that this novel means of establishing microstructure along the edge avoids frequent resharpening by conventional means is not only important to extend the life of the knife but it is a big advantage to the butcher or user not be have to interrupt their cutting operations so frequently in order to resharpen the blade.

It is critical therefore to control angle B, FIG. 9. It will be clear that if one precisely controls angle A during the preceding sharpening step it is possible with appropriate means to insure precise control of angle B between the facet and the hardened surface 5.

It is important to emphasize the novelty and value of providing in a single apparatus both a precise means of sharpening the edge facets at a very precise angle A relative to the plane of the blade face and a means of conditioning the sharpened edge by repeatedly pressing the lower portion of the facets so created against the plane of a hardened surface at a very precise and sustained angle B optimally only a few degrees larger than angle A. This unique combination insures the angular control necessary to optimize the fracturing of the edge structure and creation of the highly regular microserrated structure along the edge. By incorporating both of these critical steps in the same apparatus, the critically important required angular relationships can be insured.

Figure 10:
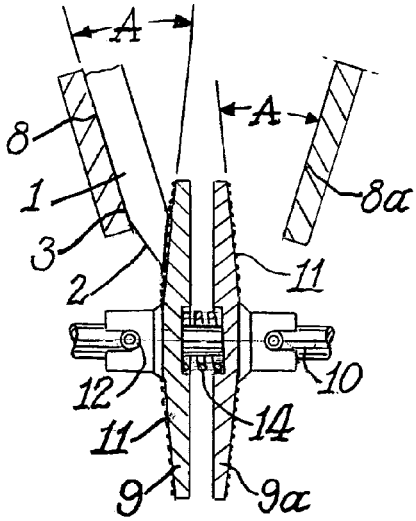
FIGS. 10-12 illustrate the sharpening of knife edges.

FIG. 10 represents a precision blade sharpening means with sufficient accuracy to sharpen a knife before it is passed through a precise edge conditioning apparatus. It contains two precision angle guide surfaces 8 and 8*a* set at angle C relative to the plane 11 of a sharpening abrasive layer on the face of rotating disks whose surface are shaped, for example as sections of conical frustums. A knife blade 1 positioned with its face 3 resting on guide plane 8 will be sharpened by this means creating a facet 2 whose plane will be created precisely at angle A relative to the face 3 of the blade. The abrasive coated disks 9 and 9*a* shown here rotate about their mounting shaft 10 driven by a motor, not shown. The disks are free to move slidingly on shaft 10 against spring 14 on shaft 10 when the disks are displaced from their rest position established by stops 12. After a facet is created on the first side of the blade as shown, the blade can be moved to guide plane 8*a* where the second facet can be created by the second abrasive coated disk 9*a* at angle A relative to the opposite guided face 3 of the blade. Sharpening devices of this sort are described in greater detail in earlier U.S. patents of these inventors.

Figure 11:
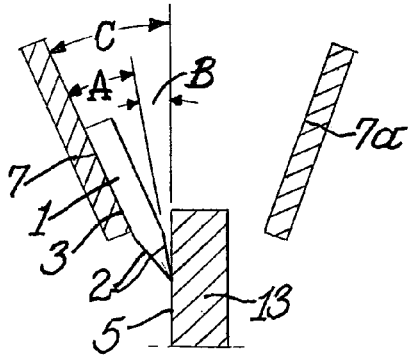

FIG. 11 represents a precision edge conditioner stage suitable for use with a precision sharpening stage. Shown are the cross section of precision elongated blade guide members having guide surfaces 7 and 7*a* and a hardened member 13. The face 3 of blade 1 as shown rests on the elongated guide surface 7 which surface is precisely set at angle C relative to the contact plane 5 of hardened member 13. If blade 1 is sharpened first in the precision sharpening means of FIG. 10, its facet 2 will be precisely at angle A relative to the elongated surface of guide 7 surface. As a consequence the plane of facet 2 is positioned (FIG. 11) precisely at angle B (angle C-angle A) relative to the plane of the hardened surface 5. It is clear consequently that by independently controlling precisely the angle A of the sharpening process of FIG. 10 and the angle C of the edge conditioning process of FIG. 11, the angle B of the conditioning process at the edge itself can be precisely controlled. In order to create the optimum microstructure along the knife edge, the angle in each of the sharpening and edge conditioning steps must be controlled independently and with precision. For the greatest precision the angles A and C will be created using the same reference feature of the blade. The most reliable reference feature of a blade for this purpose is its large elongated face. By using each of the two large faces of the blade, as references, the angle of the facets can be formed precisely at angle A. Similarly by using these same faces, as reference during the edge conditioning steps, the angle B between the facet so created and the surface of the hardened edge conditioning surface at point of contact will be precisely controlled.

As illustrated in various figures, such as FIGS. 9-11, the angle A is the angle formed between the edge facet 2 and the guide plane. In FIG. 10 angle A is the angle between the facet 2 an the plane 11 of the abrasive coated disk 9 because the facet is disposed against the abrasive surface in order for the facet to have a plane at angle A. Angle B is the angle between the edge facet and the hardened surface of the object. In the case of FIG. 10 angle B is zero. Angle C is the angle between the guide surface and the hardened surface. In the case of FIG. 10 angle C equals angle A. Angle A plus angle B equals angle C for the conditioning step shown in FIGS. 9 and 11.

Figure 11A:
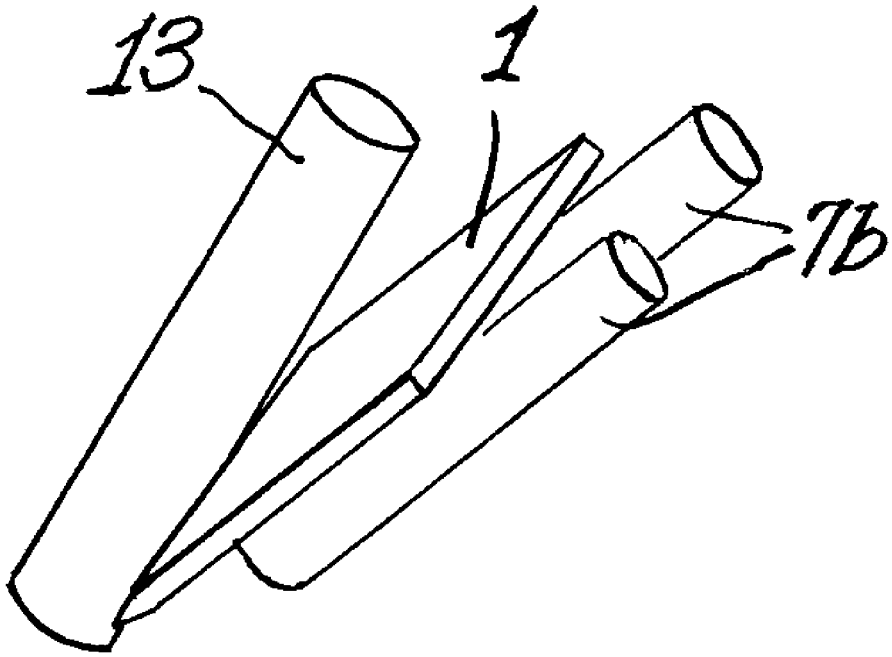

The guide surface described here can be extended flat surfaces or a series of two or more rods or rollers arranged to define an extended plane on which the blade can rest as its edge facets are being sharpened or conditioned in contact with a hardened surface. FIG. 11A, for example, shows the blade 1 guided by two rods or rollers 7*b* defining an extended guide plane opposite hardened surface member 13. It is important that the hardened surface have adequate hardness, however the supporting structure under that surface need not necessarily be of the same hardness.

Figure 12:
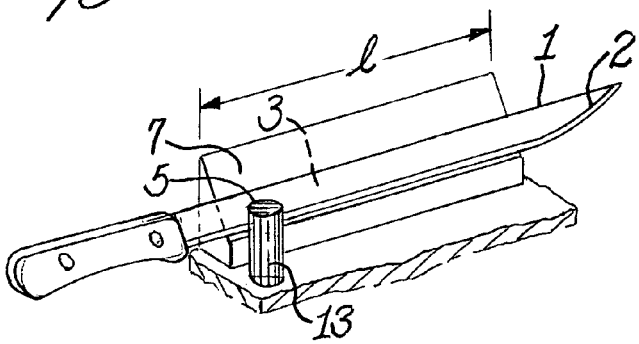

FIG. 12 shows simplistically the advantage of using an elongated guide surface 7 and the long faces of the blade 3 as reference surfaces in order to position the edge facet 2 of blade 1 at a precisely controlled angle relative to an established contact plane of the hardened surface member 13. The intimate contact of the elongated planar area 3 of the back side face of the blade with the rigid plane 7 of sufficient length, width and area does insure precise control of the angular position of the blade and its facet relative to the predetermined orientation of the hardened contact surface 5 on the member 13. The greater the length and width of the guide surface, up to the blade size the greater the precision of the angle control will be. Preferable to insure sufficient angular accuracy, the length of the guide surface is not less than 20% of blade length but generally not less than about one inch. By controlling the angle between the facet and the hardened surface by this means, the angle is remarkably consistent and free of variations due to features such as blade thickness at the edge and variations of blade width along the length of the blade. It is evident that the precision of the angle control described above in FIG. 12 using an elongated plane will be far better than that obtainable for example with a single round guide rod angularly aligned to a hardened surface to serve as the angled guide adjacent to the hardened member 13. Two rods can be set at a common angle and spaced apart to define a plane to guide the blade but an uninterrupted surface is more accurate and more convenient over the full blade length. Random variations of only a few degrees in alignment of the edge facet and hardened surface will affect noticeably the quality of the microstructure along the blade edge. Precise angle control can be obtained of course by clamping the blade in a precise mechanical arm where the precision of the arm mechanism provide the required angular accuracy. Such complex means, however are impractical in the home or industrial kitchen or butchering environments and they represent unnecessary complexity to achieve the required accuracy.

Figure 13:
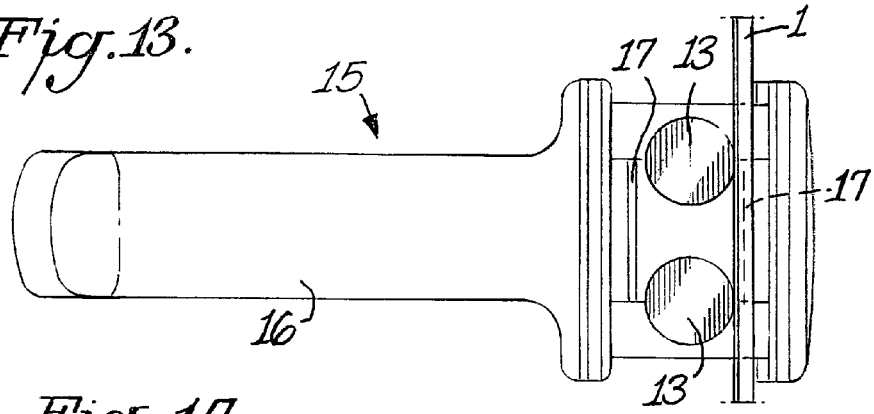
FIGS. 13-20 show various apparatus which could be used in accordance with this invention for sharpening and conditioning knife edges.
Figure 14:
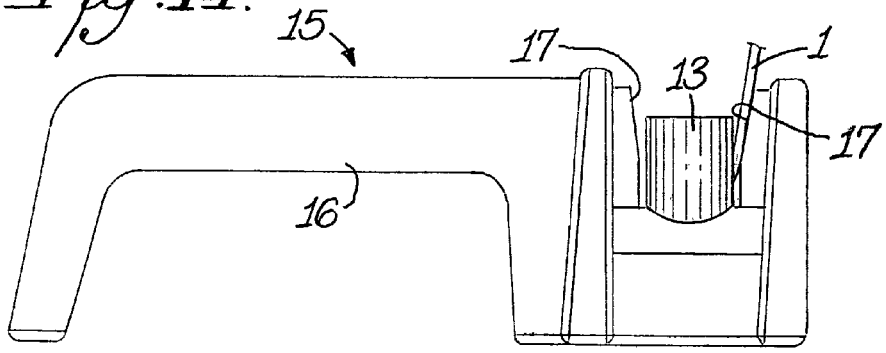
Figure 16A:
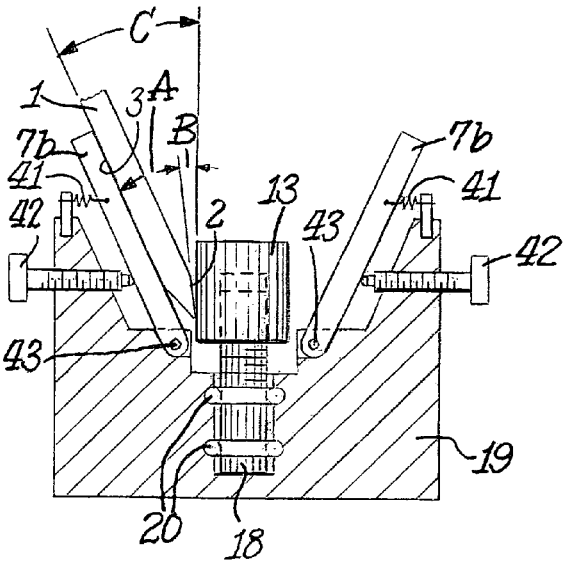

FIGS. 13 and 14 show one structure for a precision manual edge conditioner in accordance with the principles detailed above. Hardened members 13 are mounted nominally centrally between elongated knife guides 17 in a physical structure 15 which has an attached handle 16 that can be conveniently gripped with one hand while the face of blade 1 is drawn alternately with the other hand along the surface of guides 17. The length of guide 17 is adequate to insure very accurate alignment of the blade edge with the guide and the contact surface of hardened members 13. The use of two hardened members 13 is optional but it has the advantage that in the structure 15, the edge conditioner can be used conveniently by either a right or left handed operator and have the advantage of two hardened members for more rapid sharpening of some blades and the advantage that the entire length of edge can be conditioned up to the bolster or handle. Alternatively a single hardened member 13 can be similarly located between the guides. Members 13 are sized and located as shown centrally between the guides so that the edge of the blade facet will contact one or both of the members as the blade is drawn along the elongated guide surface and pressed against the contact surface of the hardened member. The angle of the elongated blade guides can be selected so that the angle between the planes of the edge facet and the plane of the hardened surface is optimized for the blade whose edge is being conditioned. Mechanical means for example such as in FIG. 16A can be incorporated to permit adjustment of the angle of the guide means so that angle C, FIGS. 11 and 16A, can be optimized for the particular angle of the facets of the blade edge being conditioned. FIG. 16A illustrates the mechanical means for adjusting the angle of the guide means. As shown therein each guide 7*b* is pivotally mounted at 43 to support member 19. A spring 41 urges each guide 76 to rotate in a direction away from hardened member 13. A stop member 42 is threadably mounted through support member 19 to limit the rotational movement of guides 76. Thus the spring force of each spring 41 urges each guide 7*b* against stop 42 to establish angle C. That angle is adjusted by adjusting the position of stop member 42. Alternatively as described subsequently a combined precision knife edge sharpener, either manual or powered together with a precision manual edge conditioner provides in one apparatus control of both angles A and C and insures optimum results of the edge conditioning step.

Hardened member 13 can be cylindrical, oval, rectangular or any of a variety of shapes. That member preferable will have a hardness greater than the blade being sharpened. The radius of its surface at the line or points of contact can be designed to optimize the pressure applied to the blade edge as it is forced into contact with that surface. That effective radius at the line or area of contact can be the result of the macro curvature of the hardened member or the result of micro structure such as grooves and ribs at that point. For best results such grooving, ribbing or ruling along the surface should be approximately perpendicular to the line of the edge being conditioned and in any event the alignment of the grooves or rulings preferably cross the line of the edge. The invention can be practiced with the axis of such ribbing at an angle other than perpendicular, including tilting the ribbed surface or spiraling the ribs to establish an alternate angle of attack.

Figure 21:
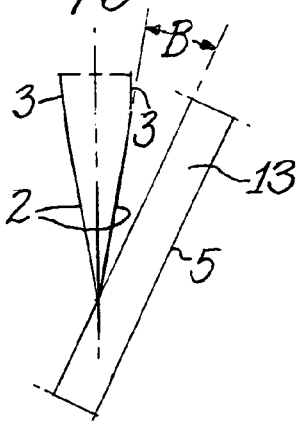
FIGS. 21 and 22 show in detail the angular relationship of the edge facet and the hardened material necessary to create this optimum edge structure.
Figure 22:
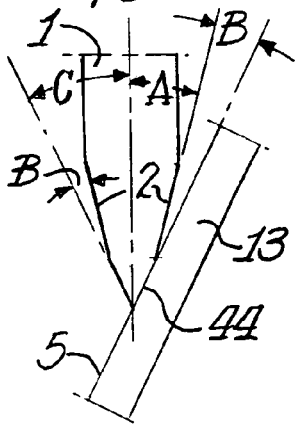

In creating the optimum edge structure by the novel and precise means described here the hardened contact surface 13 will initially make contact with the facet only at the extremity of the facet 2, FIG. 21 adjacent to the edge. As the burr is removed, the hardened surface will also remove microscopic amounts of metal adjacent to the edge and the lower most section of the facet will after many strokes, begin to be re-angled to an angle closer to that of the hardened surface. Thus a line and larger area of contact 44, FIG. 22 develops between the lower section of the facet and the contacted surface on the hardened member. This growing area of contact 44 FIG. 22 resulting from many repetitive strokes of the facet against the hardened surface is important to stabilize the localized pressure against the developing edge structure and thereby to reduce the probability of prematurely breaking off the microteeth during subsequent reconditioning of the edge. This mechanism which relies on the highly precise and consistent angular relation between the facet and hardened surface reduces the opportunity for the hardened surface to impact under the edge and knock off the microteeth by that impact rather than by the desirable repetitive wearing along the side of the facet and the resulting stress hardening and fracturing process.

It was found that localized axial ribbing along the surface of the hardened member is a convenient way to create an appropriate localized level of stress against the facet and the edge without damaging the microteeth being formed. The ribs, however are preferably individually rounded and not terminated in an ultra sharp edge that can remove metal too aggressively and consequently tear off the microteeth. The level of force must be adequate to stress the microteeth and generate fracturing below the roots of the microteeth and permit their removal and replacement after the cutting edge is dulled from use. The depth of such ribbing must also be controlled in order that such ribs can not remove a significant amount of metal along portions of the edge facets.

Figure 15:
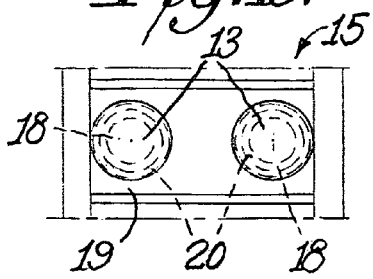
Figure 16:
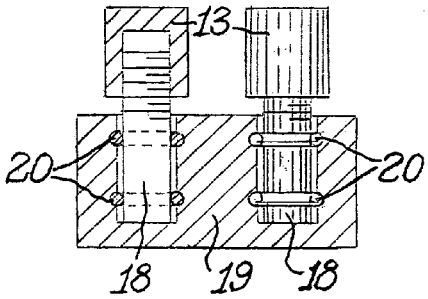

The hardened member 13, FIG. 13 can be secured rigidly to the structure 15 or alternatively the hardened member can be mounted on a structural element so that it is slightly displaceable against a restraining force as the knife edge facet is pressed into contact with the member. The restraining force can be supplied by a restraining mechanism, such as a linear or non-linear spring material or similar means. Designs are possible that allow the user to adjust or select manually the amount of restraining force and extent of displacement. FIGS. 15 and 16 illustrate one of many possible configurations that incorporate a restraining force concept. The hardened members 13 shown in FIGS. 15 and 16 can for example be cylinders or tubes with hardened surfaces or body hollowed and threaded internally that can be rotated on threaded rods 18 which extend into support member 19 drilled to accept the unthreaded sections of rods 18 which in turn are grooved to accept elastomeric O-rings 20 which support and physically center the rod 18 in the drilled holes in support member 19. If such or similar structures are mounted in the apparatus of FIGS. 13 and 14, when knife 1 FIGS. 13 and 14 is inserted along the elongated guide 17, the hardened member 13 will be contacted by the knife edge facet 2 and displaced slightly angularly or laterally by the application of sufficient downward force to blade 1, causing lateral force to be applied to O-rings 20. The degree of compression of the O-ring and the resulting angular displacement of hardened member 13 can be limited by physical stops or other means in order to maintain the contact angle B, FIG. 11, preferably within 1-2 degrees of the optimum value. By allowing the hardened member to displace slightly in this manner with a controlled resistive pressure, it is possible to minimize the opportunity for excessive forces to be applied by the operator who is applying manually the force between the knife and the hardened member. Excessive force can be detrimental to the progressive process of removing the burr and creating the microstructures along the edge in a optimum manner. However, if it becomes desirable to accelerate the rate of development of microteeth, greater pressure can be applied to the knife, the angle B will increase slightly and the microteeth will develop faster. It was discovered that there is an optimum level of resistive pressure and this apparatus provides a means to create and maintain that optimum level. Commonly a resistive force between 1 to 3 pounds is optimum. The threaded connection of the hardened member to the support rod 18 allows the user to rotate and raise or lower the hardened member 13 in order to expose fresh surfaces of the hardened member to the edge facet 2 as the surface of the hardened member becomes distorted, loaded with debris, or worn excessively by repeated contacts with the blade facets. The threaded connection can be sufficiently tight that the hardened member 13 does not rotate as the knife edge is rubbed against its contact surface. Alternatively the threaded connection may be loose enough to rotate slowly as a result of rubbing and frictional forces as the blade edge is pulled across the surface of hardened member 13. In that sense, the threaded connection may be considered a braking mechanism which prevents rotation of the rotatable cylindrical object unless a torque is applied to the cylindrical object in excess of that applied by such braking mechanism. The hardened surface preferably will impart little to no conventional abrasive action against the edge structure. If there is any abrasive action along the edge it must be sufficiently small that it does not interfere significantly with the slow process of burr removal by non-abrasive means or prematurely remove the fine microstructure being formed along the blade edge. As explained later herein, an advantage has been shown in some situations for a very light abrasive supplementary action along the edge to reduce slightly the width of the microstructure but this action must be extremely mild and applied with great care in order not to remove the microstructure being created by the hardened member.

The mechanism of FIGS. 13, 14, 15, 16 and 16A is simply one example of the configurations that can be used to carry out the precision edge conditioning process while maintaining close control of the angle B, FIG. 11, between the plane of the facet 2 and the plane of the hardened member 13. The shape of the surface and the shape of the hardened member can be varied widely to accommodate alternative means of guiding the blade accurately and of establishing precisely the angle B between the surface of hardened member 13 and the blade facet 2. Clearly a variety of alternate restraining means including wire and leaf springs can be used to position the hardened member and to allow but offer resistance to controlled displacement of hardened members. Alternative means can be used to permit movement of the hardened members to expose fresh areas on their surfaces which can be used to condition the edge. A sharpener incorporating both a precision sharpening stage and the edge conditioning mechanism shown in FIGS. 15 and 16 permits accurate control of angle B and the creation of edges with optimal conditioning as described earlier.

As mentioned earlier herein the surface of the hardened member can be embossed, ruled or given a structure or patterning that will create higher but controlled localized pressures and forces to be applied along the knife edge in order to assist in removal of the burr structure and creation of microstructure where it is otherwise necessary to apply greater manual forces on the blade itself. Such microstructure might include a series of hardened shallow fine ribs, for example 0.003 inch to 0.020 inch apart, on the surface of the hardened member where the axis of the individual ribs is preferably aligned perpendicular to but in any case at a significant angle to the line of the edge as it contacts the hardened surface. Preferable such ribs should be shallow so that they can not remove excessive amounts of metal from the facets adjacent the microstructure being formed. The plane of such ribs defined by the plane of the area, points or line of contact adjacent the contacting blade facet must, however, be maintained at the optimum angle B as described herein in order to realize the optimum microstructure. The optimum size of such ribs depends in part on the hardness of the blade material.

Possible geometries for the hardened surface needed to create the edge microstructure described here can include repetitive geometric features with small radii on the order of a few thousandths of an inch. It is important, however to understand that the conditioning step described here is not a conventional skiving operation which normally will remove, reangle or create a new facet without regard for the detailed and desired microstructure along the edge itself. Instead this invention is a precision operation to remove carefully the burr of a knife, that previously has been sharpened conventionally, by pressing the knife edge against the surface of a hardened material at a precisely controlled angle B to that surface with enough pressure to progressively and significantly remove the burr., to fracture the edge at the point of burr attachment and to create a relatively uniform microstructure along the edge. It would be counterproductive to skive off the entire facet (or to reangle the entire facet) which, like coarse and aggressive sharpening would create a new facet and recreate a conventional burr along the edge and leave a very rough and unfinished edge.

This invention is a unique means to condition a conventionally sharpened edge so that a highly effective microstructure is established along the edge while simultaneously maintaining a relatively sharp edge as defined by its geometric perfection.

A high degree of precisely repetitive micromanipulation is necessary to create this favorable type of edge. In addition to the need to establish precisely the angle between the surface of the facet and the surface of the hardened material at the point of contact, it is critical to insure that this angle of attack is maintained on each and every stroke of the knife edge along its entire length. The angle of attack must be maintained with a repetitive accuracy of approximately plus or minus 1 to 2 angular degrees. Such precise repetition is necessary to avoid seriously damaging the microteeth or altering the nature of edge structure being created along the edge. Further the pressure applied by the knife facet against the hardened surface must be optimized in order to avoid breaking off prematurely the newly formed microteeth. The force developed along the edge of the facets by the repetitive sliding contact smoothes the sides of the microteeth but stresses them and strains them in a manner that repeatedly fractures their support structure at a depth along the edge significantly below the apparent points of their attachment. This repetitive process leads ultimately to the removal of the microteeth and their replacement with a new row of microteeth created by the repetitive fracturing of the supporting edge structure below each "tooth". The amount of force exerted against the microteeth on each stroke is dependent upon the downward force on the knife blade as applied by the user. It is important to realize that the localized force against the microteeth can be very large because of the wedging effect at the blade edge between the elongated angled knife guide and the hardened surface. The force that must be applied by the user is consequently relatively. modest and certainly less than if the force had to be applied directly in the absence of a knife guide. It would be very difficult to apply consistently this level of force to the knife edge by any manual non-guided stroking procedure.

In general the hardened material should not be an abrasive. The described processes removes the burr, creates microteeth along the edge and wears micro amounts of metal from the facet adjacent the edge by basically a non-abrasive process. The rate of metal removal by any abrasive can easily be too aggressive compared to the miniscule amounts of metal that will be removed while creating and recreating the ordered line of microteeth along the edge.

The edge conditioner illustrated in FIGS. 13 and 14 contains two hardened members 13 so that the apparatus will be equally effective if used by either right or left handed persons. Clearly this arrangement permits one to condition the full length of a conventional knife, particularly including that portion of the edge adjacent to the handle or bolster. If there were in this apparatus, which has an elongated guide 17 to insure accurate angle control, only one such member 13 either the right handed or left handed person or both would find it impossible to comfortably condition the entire length of the edge to the bolster or handle of the blade. In order to condition the edge close to the bolster while providing an elongated guide for the blade face one hardened member must reside on one side of the conditioner so that the entire edge can contact it up to the bolster and handle of the blade.

As mentioned earlier, the hardened surface should not have an inherent tendency to abrade. The surface should not be coated with conventional aggressive larger abrasive particles of materials such as diamonds, carbides or abrasive oxides. These materials when in sizable particulate form typically have extremely sharp edges that give them aggressively abrasive qualities. However, these same materials are extremely hard and when prepared in large planar form and highly polished are essentially non-abrasive. The edge conditioning process disclosed here relies on precisely applied angular pressure by a hardened surface against the facet at its edge in order to repeatedly create and fracture a microstructure along the edge at the extreme terminus of the facets. The process of repeatedly rubbing the knife facet and edge structure against the harder surface stress hardens the facet adjacent to the edge, fractures the edge below the edge line and deforms the metal immediately adjacent to the edge. The metal along the lower portion of the facet adjacent the edge is deformed, smeared by the localized contact pressure and microsheared as a result of the very small differential angular alignment of the plane of the hardened surface and the plane of the edge facet. Thus the localized contact pressure slowly fractures the microteeth along an edge and slowly and selectively re-angles the lower portion of the facet to conform closely to the plane of the hardened surface. It is clear that if the differential angular alignment is too great or if there is any true abrasive action at the edge the microstructure that otherwise would be slowly created and recreated will be prematurely abraded away and destroyed. The rate of facet deformation and metal removal adjacent the edge must be minimized in order that the microstructure has time to develop and be protected from direct abrasion. The amount of wear along the lower portion of the facet that can occur from the inherent roughness of the hardened surface in the low micron range appears acceptable. Surface roughness (as contrast to dimensions of small repetitive geometric features) greater than about 10 microns will in some cases depending on pressures and the rate of microtooth development be about the practical limit in order that such roughness does not lead to excessive metal removal while the optimum microstructure is being created. Consequently it is important that the hardened surface not have significant abrasive quality.

Figure 17:
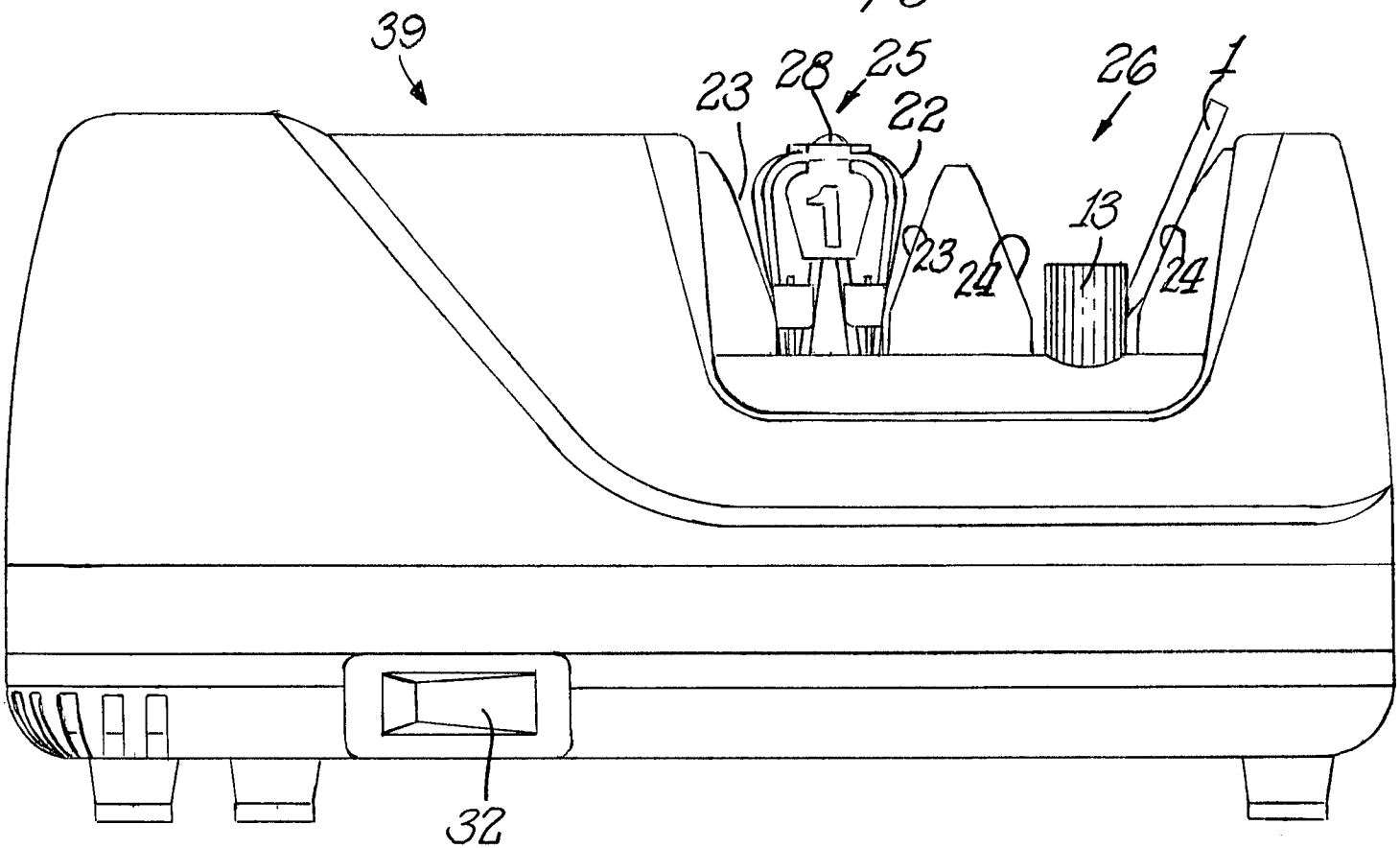
Figure 18:
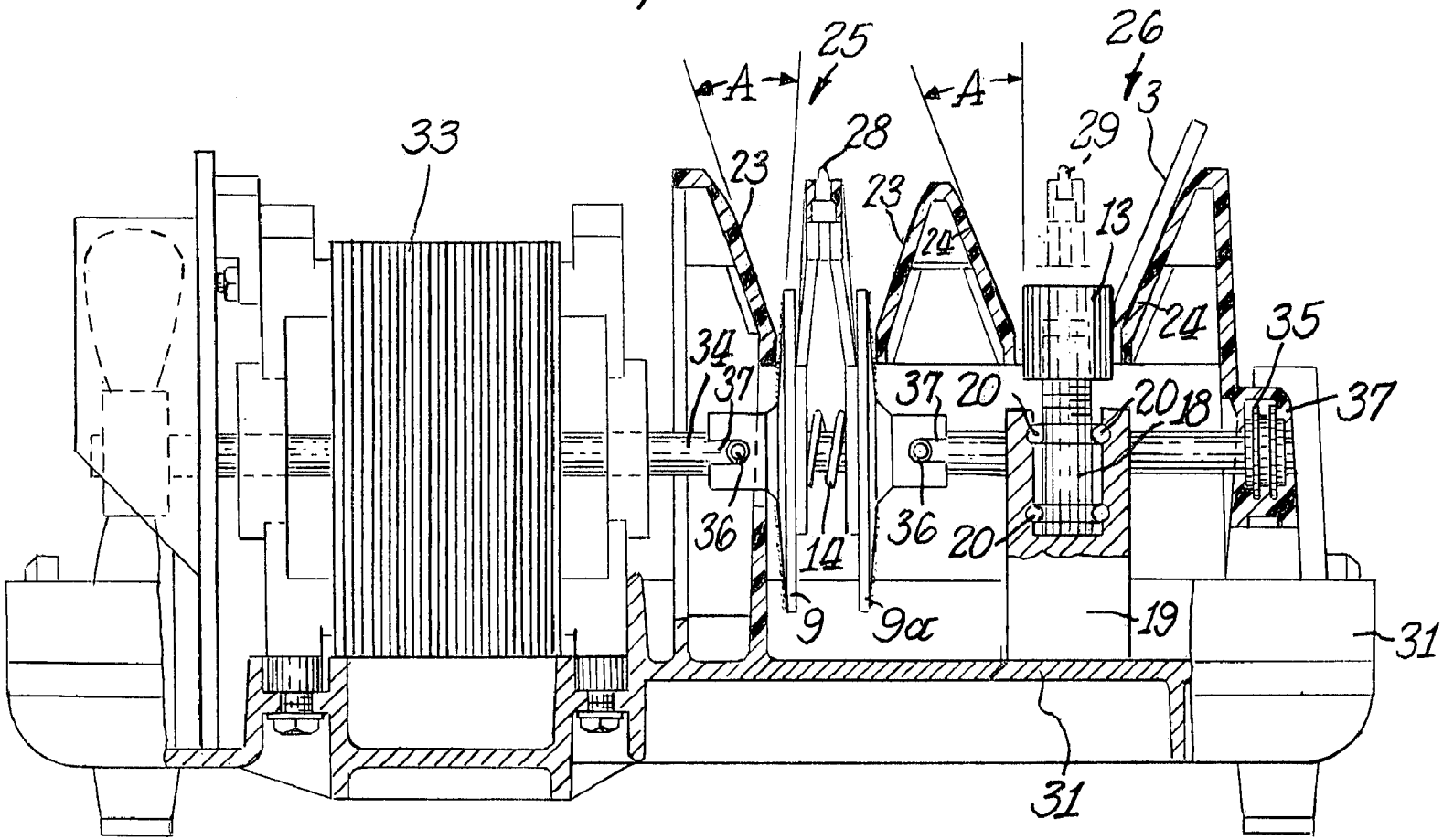

Because it is important to control angle B between the plane of the sharpened facet along the edge and the surface at point of contact with the hardened surface, in the optimal situation it is important as described above to control both angle A of the facet (FIG. 10) and angle C in the conditioning operation FIG. 11 so that the difference angle B (angle C-angle A) is closely controlled. For this reason it is now clear that there is a major advantage to creating a single apparatus 39 such as shown in FIGS. 17 and 18 including a sharpening station and an edge conditioning station 26, each with precisely controlled angles A and C respectively. The sharpening stage can be either manual or powered but in this example the sharpening stage is powered, as activated by switch 32. The first (sharpening) stage 25 of this apparatus has elongated guide planes 23 each set at angle A relative to the blade face and the abrasive surfaces. The guide planes 24 in the second (edge conditioning) stage 26 each are set at angle C relative to the contact surface of hardened member 13. The first stage FIG. 17 is shown with U-shaped guide spring 22 designed to hold the knife securely against elongated guide plane 23 as the knife is pulled along said elongated guide plane and brought into contact with sharpening disks 9 and 9*a* (FIGS. 10 and 18).

The U-shaped guide spring 22 mounted to cost 28 to hold the blade face securely against the guide surfaces 23 of FIG. 17 is illustrated for the first stage 25 but is omitted only for reasons of clarity in the second stage 26. FIG. 18, however, shows in phantom the post 29 for the guide spring in the second stage 26. This type of spring is described in U.S. Pat. Nos. 5,611,726 and 6,012,971, the details of which are incorporated herein by reference thereto. It is preferable, however to have a similar knife guiding spring 22 in the second stage 26 extending along the guide length in order to insure that the face of blade 3 is held in intimate contact with the elongated guide plane. That in turn insures that the blade facet is oriented relative to the contact surface of member 13.

The hardened member 13 is supported on structure 19 that is positioned forward of drive shaft 34 or slotted to allow uninterrupted passage and rotation of shaft 34 which is supported at its end by bearing assembly 35 supported in turn by structure 37 attached to base 31. Structure 19 likewise is part of base 31 or a separate member attached to base 31. Hardened member 13 supported by and threaded onto rod 18 in this example can be displaced laterally when contacted by the blade cutting edge facet, the amount of such displacement being controllable by selection of appropriate durometer and design of the O-Rings, 20. Alternatively member 13 can be mounted rigidly on structure 19, to be immobile, but that alternative requires slightly more skill by the user to avoid applying excessive force along the cutting edge.

Experience with an apparatus as illustrated in FIGS. 17 and 18 demonstrated the distinct improvement of creating the edge microstructure under strict consistent conditions where the angular difference B, (C-A), was accurately controlled by the precision elongated guides to fall within the range of 3-5°. The advantage of having the sharpening and edge conditioning operation in the same apparatus is clear since each of the angles A and C is predetermined by the preset angle of the elongated guides. The sharpening process which must be designed to create full facets at the desired angle A can be carried out by any of the conventional means known to those skilled in sharpening including abrasive and sciving means. It was also observed that there is an advantage of using diamond abrasives in the sharpening stage in order to create rapidly precisely ground facets with a distinct burr. Diamonds are the most effective abrasive for sharpening and for cleanly removing the metal. Consequently diamonds create without overheating a very pronounced and cleanly defined burr along the edge of any metal regardless of its hardness. The process of creating an optimum microstructure along the knife edge depends upon starting with a blade that has been sharpened sufficiently to establish well defined facets then by applying pressure at a low angular difference B alternately on one side, then the other of the edge until any burr remnants are removed leaving a microstructure along the edge. As this breakup process proceeds it can be interrupted and the knife can be used for slicing food or other objects and subsequently conditioned further to improve once again or further the cutting ability of the edge structure. This reconditioning process can be interrupted and repeated many times until the reconditioning process becomes so slow that it is desirable to resharpen the edge and start with newly formed facets. It is important to note that by maintaining a small angular difference B during this process, the edge can be reconditioned many times before it needs to be resharpened to create a fresh precision facet at angle A.

Figure 8:
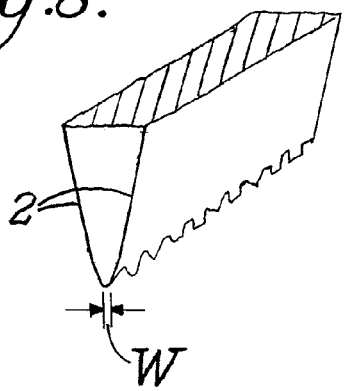

The cutting ability of a knife edge depends on a variety of factors but most important are the geometric perfection of the edge and the nature of any microstructure along the edge that can contribute to the effectiveness of cutting certain materials, especially fibrous materials as related herein. The manual and powered devices described in this disclosure are designed to optimize and control the creation of a desirable fine microstructure along the edge. In the process of creating this microstructure the burr remaining from prior sharpening is progressively removed until it is virtually all removed leaving the microstructure. As shown in FIG. 8 when the burr is removed the microstructure is created approximately as shown but the edge at its terminus may at times be wider than the edge would be if the facets 2 were to meet in a point. This is because of fragments remaining along or damaged microstructure resulting from use of the knife. These fragments in general are small but it is possible to reduce their size slightly without removing the microstructure being formed. It was found that by using a finishing process in the form of an extremely mild buffing or stropping action (not aggressive) precisely set at an angle very close to angle C it is possible if needed during the edge conditioning step to reduce the size of such fragments along the edge without significantly removing the microstructure being created by the means described. The effective angle D, FIG. 20 of this mild buffing means must be very close to angle C. It is evident that if it is exactly at the facet angle A, FIG. 10, it can remove any debris outside the geometric projection of the facets and remove only minimal amounts of material from the facet itself. Such abrasive action if sufficiently mild can sometimes improve the geometric precision of the edge and reduce slightly the thickness of the edge without removing the tooth like structure of the microstructures created by the edge conditioning step. Experience shows such subsequent mild action can improve slightly the cutting ability of the edge for some materials. It is also clear that if angle D of this mild action step significantly exceeds angle C, it will rapidly remove the desired microstructure along the edge and create a burr structure. Hence this finishing operation must be conducted under highly controlled conditions at precisely the optimum angle related to the angle A of the initial aggressive sharpening action that created the original facets and the original burr.

Figure 19:
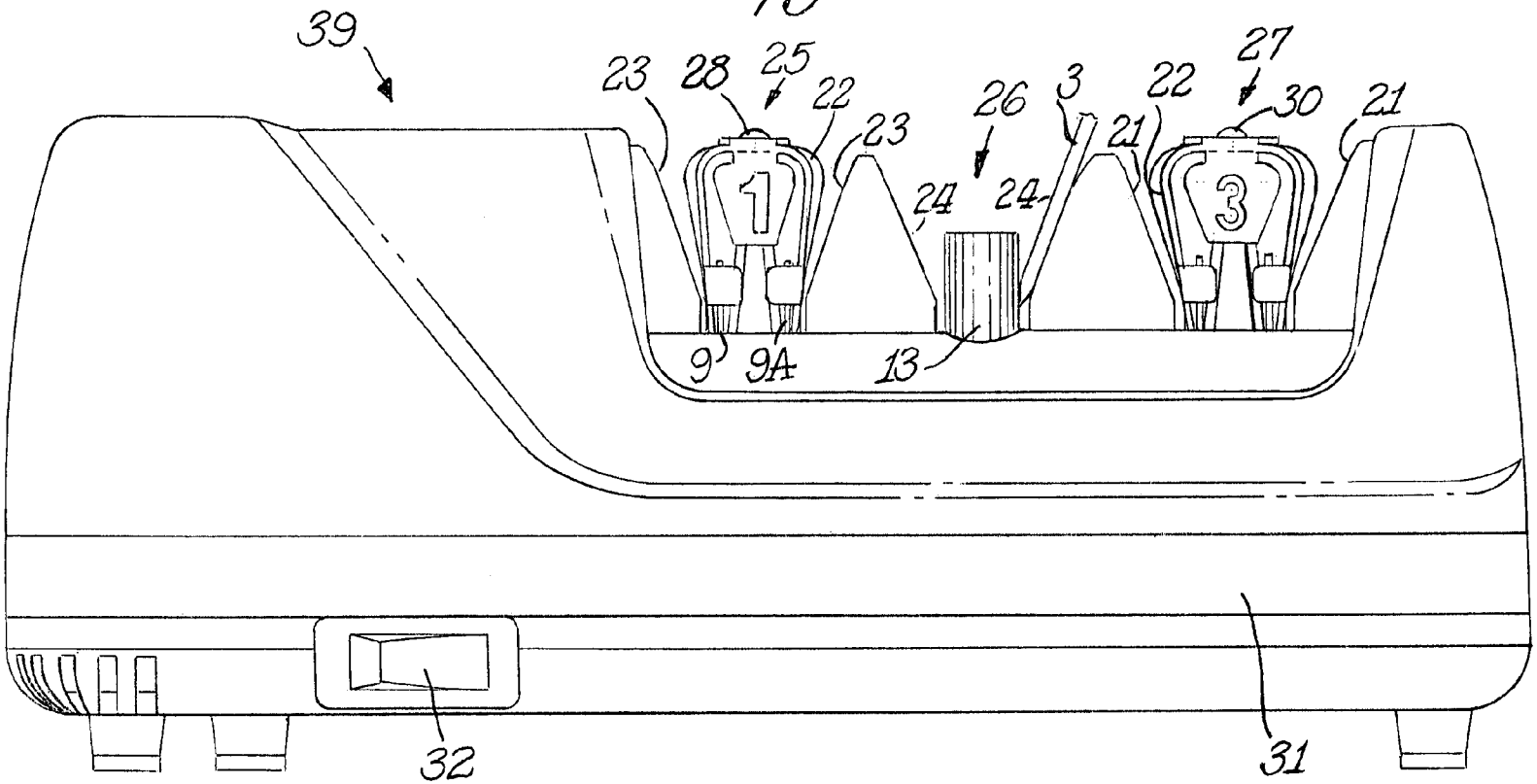
Figure 20:
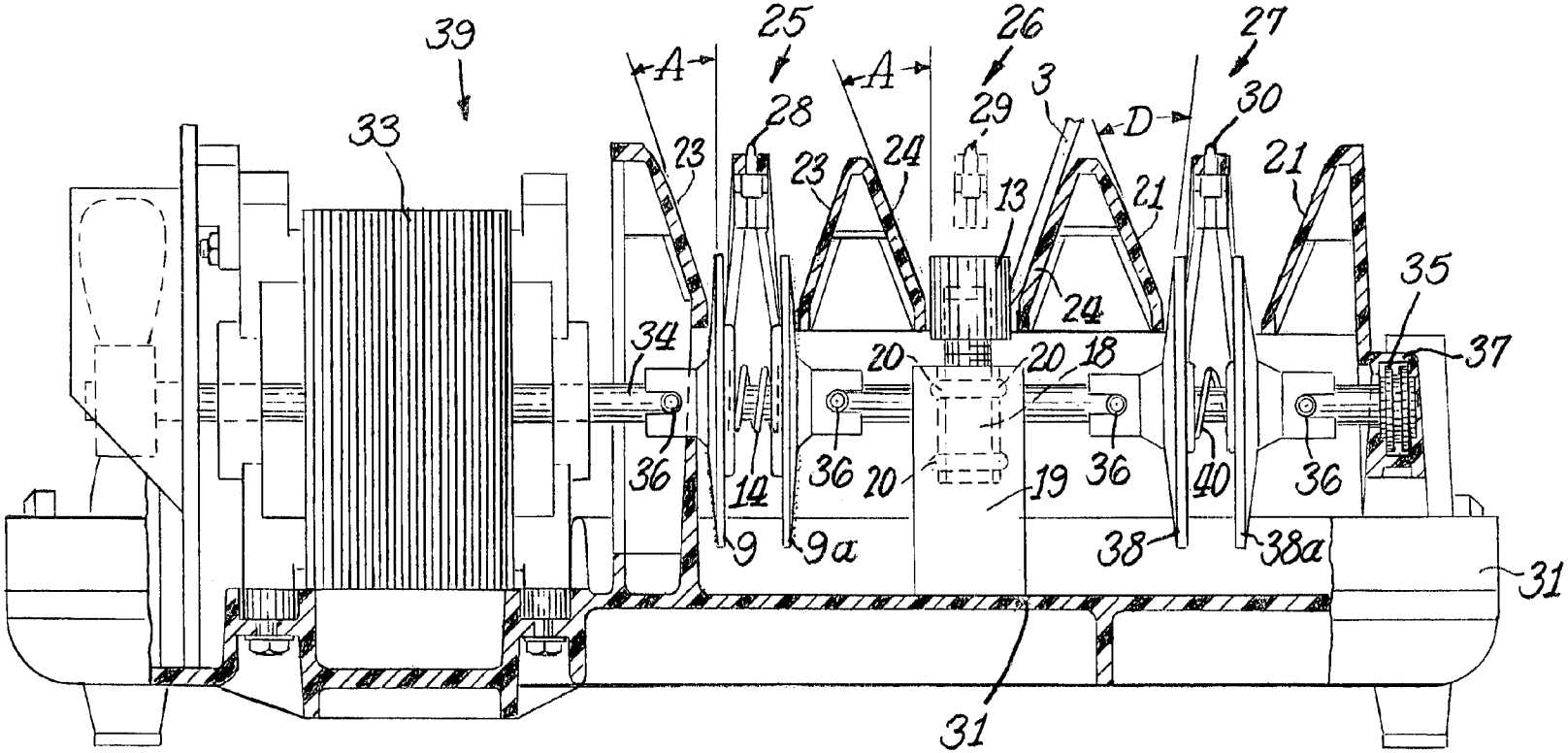

FIGS. 19 and 20 illustrate a motor driven three stage edge conditioning apparatus that includes a sharpening stage 25 designed to operate at angle A, an edge conditioning stage, 26 designed to operate at angle C, and a finishing stage 27 using a very mild buffing or stropping action designed to operate at angle D which must be close to angle C, preferable within 1 or 2 degrees. All of these angles are the angle between the controlling guide plane of that stage and the angle of the contact surface of the abrasives 9, 9*a*, 38 and 38*a* or the surface of hardened member 13. In this apparatus FIGS. 19 and 20 the first stage 25 might for example use abrasive disks 9 and 9*a* coated with 270 grit diamonds. The third stage disks 38 and 38*a* could be made of ultra-fine 3-10 micron abrasives, such as aluminum oxide embedded in a flexible matrix as described in earlier U.S. Pat. Nos. 6,267,652 B1 and 6,113,476, the details of which are incorporated herein by reference thereto. In the third stage 27 the grit size preferably must be small (less than 10 microns) and the force of the restraining spring 40 or its equivalent must be exceedingly small, preferably less than 0.2 pounds, in order to avoid an action so great that the microstructure developed in Stage 2 would be prematurely removed or damaged.

In FIGS. 19 and 20, the edge conditioning stage two, 26 is basically the same as described earlier with reference to FIGS. 17 and 18. The guides for that stage are maintaining accurately the angle C.

Fresh areas of the surface on the hardened member 13 can be exposed by rotating the member on the threaded section of rod 18. While not shown, a hold-down spring such as spring 22 would generally be incorporated to press the face of blade 3 securely against the plane of elongated guides 24 in order to insure accurate angle control during the edge-conditioning process.

Fresh areas of the surface on the hardened member 13 can be exposed by rotating the member on the threaded section of rod 18. While not shown, a hold-down spring such as spring 22 would generally be incorporated to press the face of blade 3 securely against the plane of elongated guides 24 in order to insure accurate angle control during the edge-conditioning process.

FIGS. 19 and 20 show the posts 28 and 30 for mounting the guide springs 22 for stages 25 and 27. FIG. 20 illustrates in phantom the post 29 that would mount the guide spring for stage 26.

The surface of disks in both the first stage 25 and the third stage 27 can, for example be sections of truncated cones. In determining the precise angles of contact in these stages it is important to establish the vertical angle between the plane of the surface of the guide and the plane of the surface on the abrasive surface at that point of knife-edge contact with the blade facet. The guides 23, 24 and 21 are elongated to permit accurate angle control as the face of the blade is moved in intimate contact with the elongated plane of the guide face. The disks 38 and 38*a* rotated on shaft 34 at for example about 3600 RPM can move laterally by sliding contact with the shaft against the restraining force of spring 40. By allowing the disk to move in this manner slidingly away from the knife facet as that facet is brought into contact with the surface of the disk, the opportunity for the abrasive to gouge the knife edge or to damage the microstructure is substantially reduced. As in the earlier FIG. 18, the lateral position of the drive shaft 34 is accurately established by the precision bearing assembly 35 held securely in a slot of structure 37 attached to the apparatus base 31. By accurately establishing the lateral position of the shaft 34, the disks are located precisely laterally relative to the guides 21, 24 and 23.

To use this apparatus the motor is energized and the blade is pulled several times along the guide plane with the edge facet in contact with the rotating disks 9 and 9*a* while alternating pulls in the left and right guides 23 of stage 1 until the facets and a burr are developed along the blade edge. The knife is then pulled along elongated guide plane 24 with the facet in contact with hardened member 13, a number of times alternating pulls along the left and right guides 24 of stage 2. The knife can then be used for cutting or it can first be pulled rapidly once along the left and right guides of stage 3 holding the blade edge in contact with the rotating disks 38 and 38*a*. Stage 3 must be used sparingly so as not to remove the microstructure along the edge. When the effectiveness of the blade is reduced from cutting, the blade edge can again be conditioned in stage 2. The edge can be reconditioned many times before it must again be sharpened in stage 1 as described above.

The preceding descriptions discloses number of skill-free means for reproducibly creating a uniquely uniform microstructure along the edge of a sharpened blade where the means incorporates a highly precise angular guiding system for the blade so that very narrow areas of the blade facets adjacent the edge can be repeatedly moved across a hardened surface at exactly the same angle, stroke after stroke. This highly controlled action stress hardens the lower portion of the facets within about 20 microns of the edge causing fractures to occur in a reproducible manner in that small zone adjacent to the edge which in turn causes microsections of the edge to drop off along the edge leaving a highly uniform toothed structure along the edge. The teeth so created are commonly less than 10 microns high and are spaced along the edge every 10 to 50 microns. These dimensions are comparable to or substantially less than the width of a human hair. The several apparatus already described herein operate by moving the knife edge against the hardened surface. A similar result can be realized by moving the hardened surface along the edge of a stationary knife edge but only if the angle of the hardened surface at the point or area of contact is held at precisely the same angle stroke after stroke. For optimum results the angular difference between the plane of the edge facet and the contact plane of the hardened surface should be on the order of 3-5 degrees and preferably less than 10°.

If the angular difference exceeds 10° the nature and frequency of the microteeth changes significantly and the cutting ability of the resulting edge is adversely affected. Above 10° the microteeth are individually smaller, the spacing of teeth becomes less regular and at increasing angles the total number of substantial teeth is reduced. Further and importantly, at larger angle B the edge width W is greater and the edge is not as sharp. The advantages of keeping angle B small, for example, below 10° is clearly evident. It is also clear that in order to keep the conditioning angle C within such close proximity to the sharpening angle A on each and every conditioning stroke it is necessary to use precision guiding means. That is the only way the results described here can be obtained.

Figure 23:
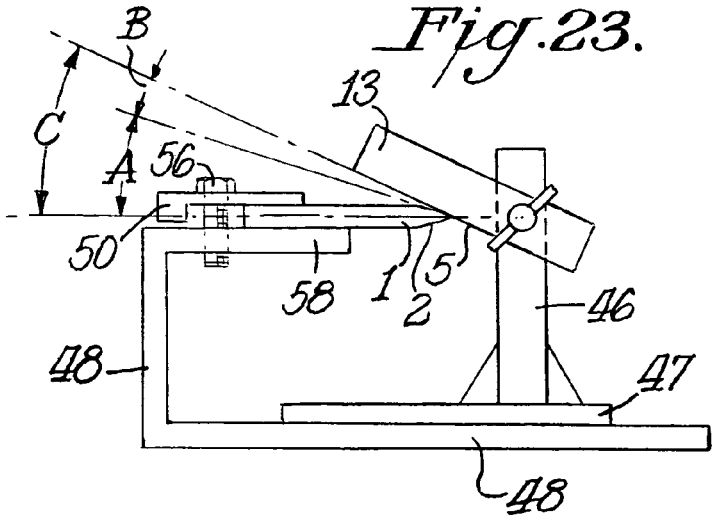
FIGS. 23-24 show practices of the invention with a clamped blade and precision means of moving a hardened object across or along the blade edge.
Figure 24:
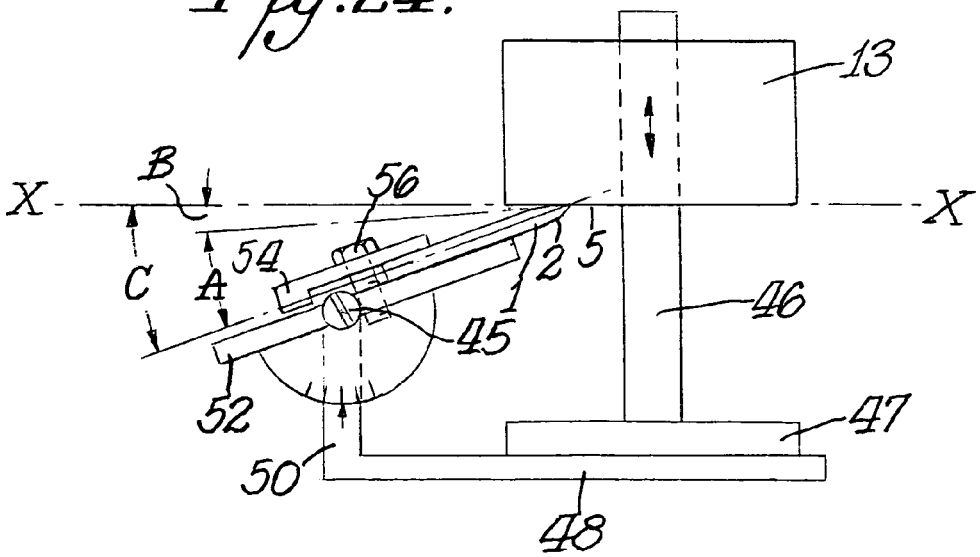

Two examples of an apparatus that creates similar microstructures by movement of a hardened surface along the edge of a blade at a controlled angular difference between the plane of the edge facet and the plane of the hardened surface are shown in FIGS. 23 and 24. In the first example FIG. 23, the blade 1 is mounted with its axis nominally horizontal. The plane of the edge facet is positioned at an angle of A degrees from the horizontal where A is the angle of the upper facet 2. The angle of the plane of the hardened surface 5 to the horizontal is adjustable and is shown set at angle C. The angular difference between the plane of the edge facet and the plane of the hardened surface is consequently C minus A equal to angle B, which optimally must be on the order of 3-5° and preferably less than 10°.

The hardened member 13 is attached adjustably to post 46 which is mounted on pedestal 47 that can move slidingly along the angled base member 48. As the hardened member 5 is so moved manually along base member 48 in sliding contact with the lower portion of the upper facet 2 adjacent the edge, the amount of pressure applied to the edge facet by the hardened surface can be controlled by the user by pushing the hardened member with more or less force against the facet. The base member 48 is designed to support the blade 1 which is clamped to the upper platform 58 of base 48 by means of clamp 50 and an attachment screw 56.

In a second example of an apparatus incorporating a moving hardened surface 5, FIG. 24, the blade 1 is mounted so that the angular plane of its upper facet 2 is just B degrees less than the horizontal plane X-X that corresponds to the lower surface 5 of the hardened cylinder 13 which is lowered into physical contact with the edge of the upper blade facet 2. By adjusting angle C by means of the angle adjustment screw 45 the absolute value of angle B can be varied to the optimum level. The under surface of the weighted and hardened cylinder 5 can be smooth or scored with fine radial grooves and ribs in order to provide smaller areas of contact with the edge facet and thus provide greater stress levels along the edge for stressing and fracturing the edge as described earlier. The weight of the cylinder can be optimized or springs (not shown) can be added if needed to optimize the load placed on the facet by the hardened surface 5. The hardened surface can be moved slidingly along the height of post 46 which is attached to pedestal 47 which is free to slide on the angled base member 48. The angled base member has a vertical post 50 on which is mounted an angularly adjustable plate 52 that holds the blade 1 by means of clamp 54 and fastening screw 56.

What is claimed is:

1. A knife edge conditioning apparatus for manually modifying the physical structure along an elongated edge of a stroked knife blade, the blade having two faces that at their terminus have been sharpened forming two edge facets that intersect to create the elongated edge at the junction of the two facets, said apparatus comprising at least one precision knife guide having a planar knife face contacting surface along which the face of the blade can be stroked in sustained moving contact with a hardened surface of an object located adjacent to and at an angle to said guide surface, said object being non-motor-driven, said hardened surface being of non-planar shape to maintain sustained contact with and locally stress and fracture the edge of the blade at the location of contact with said hardened surface on repeated stroking to create a microscopic serration along the edge, said hardened surface being substantially free of abrasive particles and free of sharp edges characteristic of abrading, skiving and metal removing tools, and where said object in a rest position can be displaced by an exerting force exerted by the blade edge against said hardened surface of said object against a predetermined restraining force of a resilient structure that upon release of said exerting force repositions said hardened surface to said rest position.

2. An apparatus according to claim 1 where said hardened surface has an arcuate shape at said location of contact.

3. An apparatus according to claim 1 where said precision knife guide has an elongated flat surface which comprises said planar knife face contacting surface.

4. An apparatus according to claim 1 where said object has said hardened surface at two opposite locations, and one of said knife guides being disposed at each of said two opposite locations.

5. An apparatus according to claim 1 where said hardened surface is the surface of a stationary object.

6. An apparatus according to claim 1 where said hardened surface is the surface of a rotatable cylindrical object.

7. An apparatus according to claim 6 where a braking mechanism prevents rotation of said rotatable cylindrical object unless a torque is applied to said cylindrical object in excess of that applied by said braking mechanism.

8. An apparatus according to claim 1 where said object is adjustable in order that different areas of said hardened surface of said object can be selected as said location of contact.

9. An apparatus according to claim 1 where said hardened surface of said object is serially grooved with a plurality of grooves at said location of contact, and said grooves being oriented angularly to cross the elongated edge as the edge is moved across said grooved hardened surface.

10. An apparatus according to claim 1 where said hardened surface has a hardness above Rockwell C-60.

11. An apparatus according to claim 1 where said apparatus is a conditioning station in a device having a handle outwardly of said station.

12. An apparatus according to claim 1 where there are at least two linearly aligned of said objects each having said hardened surface, and said knife guide having said planar knife face contacting surface for use with said at least two objects.

13. An apparatus according to claim 1 where there are two of said knife guides which are parallel to each other with said object between said knife guides.

14. An apparatus according to claim 1 where said knife guide comprises at least two aligned rods or rollers which define an extended guide plane, and said extended guide plane being said knife face contacting surface.

15. An apparatus according to claim 1 where said hardened surface has a surface roughness no greater than 10 microns.

16. An apparatus according to claim 1 including a physical member to contact the knife blade and apply a force to press the blade against said knife guide as the blade is moved along said knife guide with the blade edge in sustained contact with said hardened surface.

17. An apparatus according to claim 1 comprising a set of said hardened surfaces and one of said precision knife guides adjacent said hardened surfaces, including an inverted U shaped spring member having cantilevered resilient arms and an intermediate connection portion, said connecting portion being between said set of hardened surfaces, and each of said arms of said spring member extending downwardly generally along a portion of a respective one of said precision knife guides.

18. A knife edge conditioning apparatus for manually modifying the physical structure along an elongated edge of a stroked knife blade, the blade having two faces that at their terminus have been sharpened forming two edge facets that intersect to create the elongated edge at the junction of the two facets, said apparatus comprising at least one precision knife guide having a planar knife face contacting surface along which the face of the blade can be stroked in sustained moving contact with a hardened surface of an object located adjacent to and at an angle to said guide surface, said object being non-motor-driven, said hardened surface being of non-planar shape to maintain sustained contact with and locally stress and fracture the edge of the blade at the location of contact with said hardened surface on repeated stroking to create a microscopic serration along the edge, said hardened surface being substantially free of abrasive particles and free of sharp edges characteristic of abrading, skiving and metal removing tools, where said object is mounted on a support member, said knife guide being pivotally mounted to said support member, and adjusting structure controlling the angle of orientation of said knife guide.

19. In a knife-edge enhancing apparatus for modifying the physical structure along an elongated edge of a knife blade, the blade having two faces that at their terminus have been sharpened forming two edge facets that intersect to create the elongated edge at the junction of the two edge facets, said apparatus comprising at least one precision angle knife guide with which one face of the blade maintains sustained contact in order to guide the elongated edge of the blade into sustained contact with a blade edge contacting member, the improvement being in that in place of a sharpening member having an abrasive surface as the contacting member, the contacting member is a knife-edge conditioning member which is a hardened surface of an object located to position a plane of one adjacent edge facet at a precise predetermined non-zero degree angle B relative to the plane of contact with said hardened surface, there being at least one of said object with said hardened surface disposed at said at least one precision angle knife guide whereby each of the blade faces may selectively be placed against said guide surface of said at least one precision angle knife guide to selectively dispose each of the facets against said hardened surface at said angle B, said hardened surface being sufficiently non-abrasive which in combination with said knife guide comprises means to repeatedly create and fracture a microstructure along the edge of the blade at the extreme terminus of the edge facets during repeated contact of the facets and said hardened surface to create a microserrated edge, said hardened surface of said object being restrained in a predetermined rest position relative to and adjacent said precision knife guide by a restraining mechanism that applies a restraining force to position said object in said rest position, and said object being displaceable against the force of said mechanism by the force applied by the blade facet contacting said hardened surface of said object.

20. In a knife-edge enhancing apparatus for modifying the physical structure along an elongated edge of a knife blade, the blade having two faces that at their terminus have been sharpened forming two edge facets that intersect to create the elongated edge at the junction of the two edge facets, said apparatus comprising at least one precision angle knife guide with which one face of the blade maintains sustained contact in order to guide the elongated edge of the blade into sustained contact with a blade edge contacting member, the improvement being in that in place of a sharpening member having an abrasive surface as the contacting member, the contacting member is a knife-edge conditioning member which is a hardened surface of an object located to position a plane of one adjacent edge facet at a precise predetermined non-zero degree angle B relative to the plane of contact with said hardened surface, there being at least one of said object with said hardened surface disposed at said at least one precision angle knife guide whereby each of the blade faces may selectively be placed against said guide surface of said at least one precision angle knife guide to selectively dispose each of the facets against said hardened surface at said angle B, said hardened surface being sufficiently non-abrasive which in combination with said knife guide comprises means to repeatedly create and fracture a microstructure along the edge of the blade at the extreme terminus of the edge facets during repeated contact of the facets and said hardened surface to create a microserrated edge, a predetermined fixed angle C being formed between said guide surface of said knife guide and said plane of contact of said hardened surface, said hardened surface having a hardness above Rockwell C-60, said object being mounted to a support member, said knife guide being pivotally mounted to said support member, and adjusting structure controlling the angle of orientation of said knife guide.

* * * * *